US006604969B2

(12) United States Patent
Altman

(10) Patent No.: US 6,604,969 B2
(45) Date of Patent: Aug. 12, 2003

(54) LUBRICATING BINDING FOR WATER RECREATIONAL DEVICES

(76) Inventor: Scott Altman, 4418 Tidewater Dr., Orlando, FL (US) 32812

( * ) Notice: Subject to any disclaimer, the term of this patent is extended or adjusted under 35 U.S.C. 154(b) by 0 days.

(21) Appl. No.: 09/823,478

(22) Filed: Mar. 31, 2001

(65) Prior Publication Data

US 2002/0142682 A1 Oct. 3, 2002

(51) Int. Cl.[7] ..... B63B 35/85
(52) U.S. Cl. ..... 441/70; 280/636
(58) Field of Search ..... 384/286, 293; 280/636; 441/70

(56) References Cited

U.S. PATENT DOCUMENTS 3,845,965 A * 11/1974 Lipe ..... 280/636

FOREIGN PATENT DOCUMENTS

CH 677614 * 6/1991

* cited by examiner

*Primary Examiner*—Stephen Avila
(74) *Attorney, Agent, or Firm*—Van Dyke & Associates, P.A.

(57) ABSTRACT

Disclosed herein is a binding for a water recreational device, which comprises a system for lubricating portions thereof to assist the user in inserting his/her foot into the binding. Also disclosed are methods and kits relating to such lubricating binding system.

9 Claims, 4 Drawing Sheets

LUBRICATING BINDING FOR WATER RECREATIONAL DEVICES

BACKGROUND OF THE INVENTION

Water-skiing is a recreational activity that has been enjoyed worldwide for several decades. Water-skiing is also a professional sport, which has regional and international governing bodies (e.g. USA Water Ski; and International Water Ski Federation). Several different types of water-skiing are commonly recognized and classically include, e.g., slalom, trick, and jumping. Recently, other categories of water-skiing have been developed as a result of the inception of new ski devices, such as the hydroslide and most recently the wakeboard. All of these types of water-skiing have some common components: the water-skier is towed by a boat and the water-skier is positioned on a device that displaces water as the boat tows the water-skier.

Generally, in most types of water-skiing, the water-skier is secured to the surface of the ski device by a binding. The typical configuration of a binding relates to a two piece construction with a portion of material forming the heel piece and a separate portion of material forming the forefoot piece. The two portions of material are brought adjacent to each other to form a foot socket, whereby the user slides their foot in the top between the two pieces and into the socket. Ski bindings have undergone many improvements over the years. Due to the potentially extreme torsional forces on the foot, ankle, and lower leg of the skier, it is important for the binding to snugly fit the foot of the skier. One augmentation to the ski binding that has been developed and is still preferred today to increase the stability of the skier's foot and combat these torsional forces is the addition of one or more flaps that wrap around the ankle portion of the binding. Concomitant with this increase in support and stability of the binding is an increase in the difficulty in inserting the skier's foot into the binding. Typically, the heel enclosure and the tongue of the forefoot enclosure extends upwardly and about the ankle. In most conventional bindings, the top of the heel enclosure and tongue of the forefoot enclosure define holes thereon which facilitate the separation of the two. However, the contact between the top of the heel enclosure and the tongue of the forefoot portion can be so tight that it is often necessary for the skier to apply a lubricant (e.g., liquid soap) in the top of the binding to aid in the insertion of the skier's foot. Maintaining a container of lubricant in the boat can be a messy inconvenience.

SUMMARY OF THE INVENTION

The subject invention pertains to an improvement in ski bindings, wherein the improvement involves the provision of a reservoir for holding a lubricant that is securely attached or integral to the binding. The lubricant can be stored and easily ejected out of the reservoir, through a simple pump and duct mechanism, to the site of need on the binding. Preferably, the reservoir is aerodynamically configured and sized as to minimize interference with the performance of the binding. Preferably still, the pump mechanism is squeezable or depressible by hand.

Another aspect of the subject invention pertains to a method of facilitating the insertion of a user's foot into a binding.

A further aspect pertains to a kit comprising a reservoir for storing a lubricant, fastener for attaching the reservoir to a binding, and instructions for use. Means for attachment can include, but is not limited to, screws, rivets, snaps, hook and loop fabric, and other fasteners. Those skilled in the art will appreciate that fasteners are preferably made from a plastic or rubber type of material, although metals could be used but would not be preferred due to potential for rusting and accidental penetration into the skin.

These and other advantageous aspects of the subject invention are described in further detail below.

DESCRIPTION OF THE PREFERRED EMBODIMENTS

The term "lubricant" as used herein refers to any substance or compound that acts to decrease the friction coefficient between two surfaces. Preferred lubricants for use with bindings according to the teachings herein include, but are not limited to, soaps, detergents, creams, oils, jellies or combinations thereof. It is preferred that once the skier has inserted his foot in the binding, the lubricant is easily washed away as the binding is submersed in water. Therefore, preferred substances for the lubricant are liquid soaps.

The term "binding" as used herein takes on its commonly understood meaning in the art, and refers to any type of structure designed for securing a foot to a water recreational device. Examples of common types of bindings used in the art are shown in U.S. Pat. Nos. 4,389,200; 6,036,561; 5,868,594; and 5,947,781.

The term "water recreational device" as used herein refers to any type of device designed for planing on water as the user is being towed. Examples of water recreational devices used in association with the subject bindings include skis (jump, trick, slalom etc.), hydroslides, wakeboards, and other similar existing devices or similar devices that have yet been developed.

As used herein, "fluid communication" refers to a connection, either direct or indirect (for example, via an intervening duct), such that fluid can flow to and from those items communicating.

Figure 1:
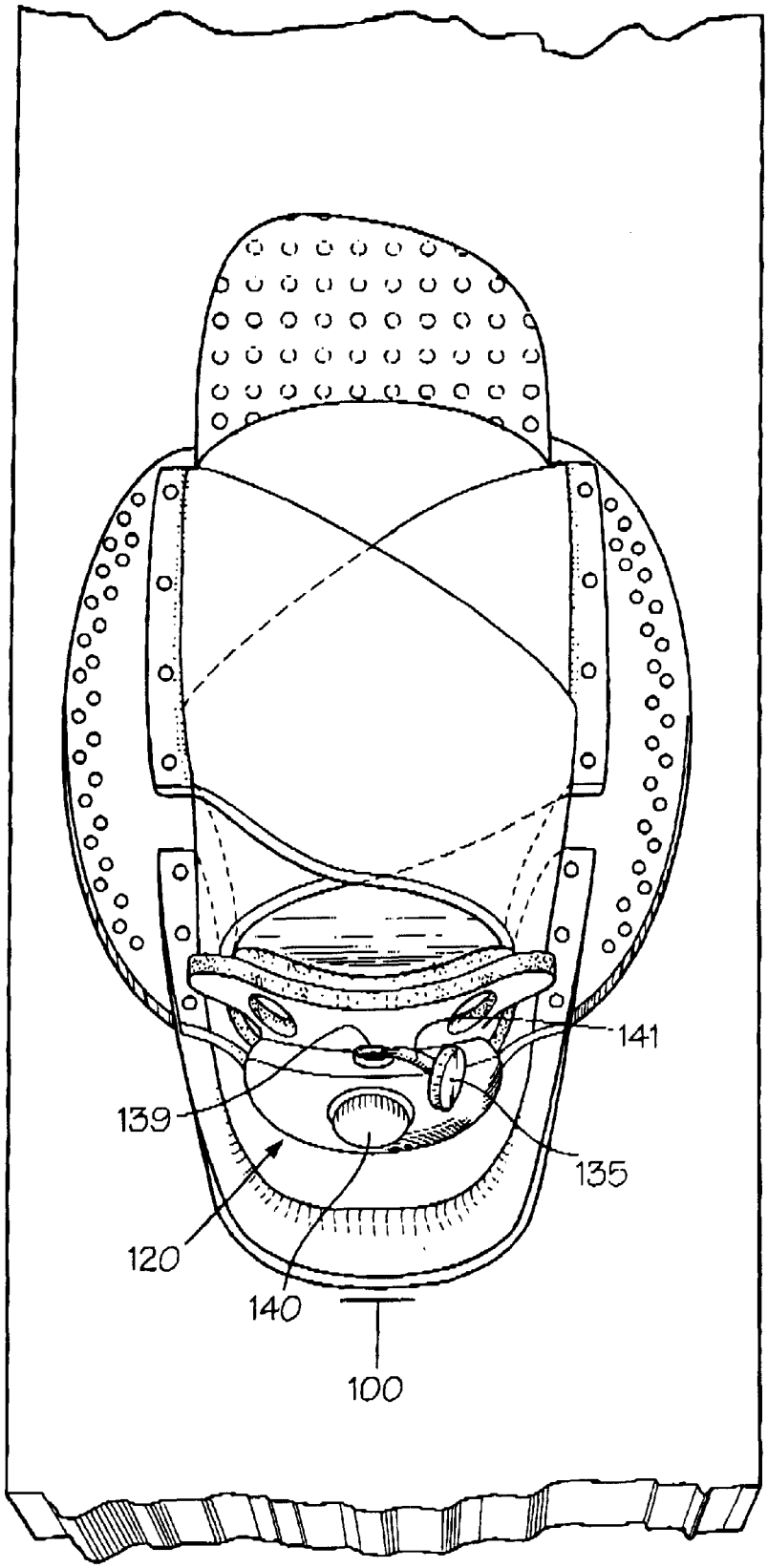
FIG. 1 shows a top view of an embodiment of the subject lubricating binding comprising the reservoir for storing and pumping a lubricant.

Now turning to the Drawings, FIG. 1 shows an embodiment 100 of the subject lubricating binding, which comprises a reservoir body 120 for storing a lubricant. The reservoir body is shown with a pump button 140, which comprises a simple pump mechanism for transferring the lubricant through ducts 110 (see FIGS. 2 and 3) and ejecting the lubricant out of the ducts 110 at the site of need. Preferably, the lubricant is delivered at the top of the binding where the user's foot slides into the binding. The reservoir body defines an aperture 139 at the top of the reservoir body 120 for receiving and filling the reservoir body 120 with lubricant, and comprises a snap-on cap 135 which snaps on to the top of the reservoir body 120. The removable snap-on cap 135 comprises an anchor 141 which keeps the cap proximate to the reservoir body 120 and helps avoid losing the cap 135. While the snap-on cap is a preferred embodiment, other fastening methods may be used to secure the cap onto the reservoir body, such as a threaded neck and cap, or hinged cap.

Alternatively, the reservoir body 120 is squeezable itself, whereby the squeezing action of the reservoir body 120 acts to pump the lubricant to the site of need. This alternative embodiment makes a separate pump button unnecessary. Those skilled in the art will appreciate that other mechanisms can be used to actuate the pumping of the lubricant to the site of need such as a lever, switch, bulb etc.

Those skilled in the art will also appreciate that the pumping can occur through numerous conventional manual pump configurations widely used in the art. One example includes a first duct (not shown) having an open end in the reservoir for intake of the lubricant, and which is connected to the pump button, and where ducts 110 are connected to the pump button. One or more valves are positioned strategically, whereby upon depression of the pump button, lubricant is drawn into the first duct through vacuum action, and flows through ducts 110 where the lubricant is ultimately delivered to the site of need. U.S. Pat. Nos. 5,987,779; 5,074,765; 4,684,484 and 4,197,825, and the references cited, described various pump configurations that are easily adapted for use with the teachings herein.

Figure 2A:
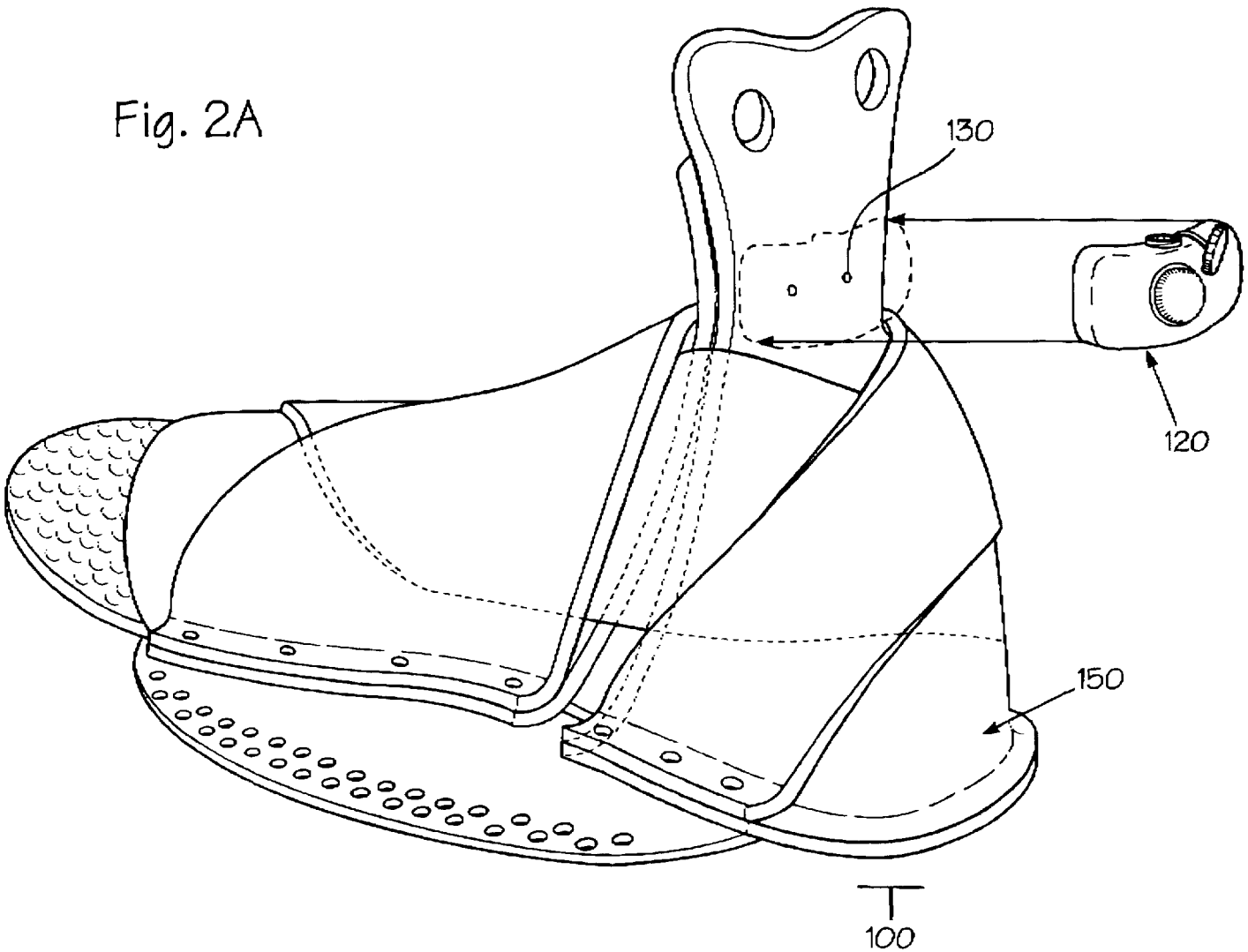
FIG. 2 shows a rear perspective view of the embodiment shown in FIG. 1, which illustrates the reservoir being positioned near the opening of the binding (FIG. 2A) and another embodiment which shows the reservoir positioned near the base of the binding (FIG. 2B).
Figure 2B:
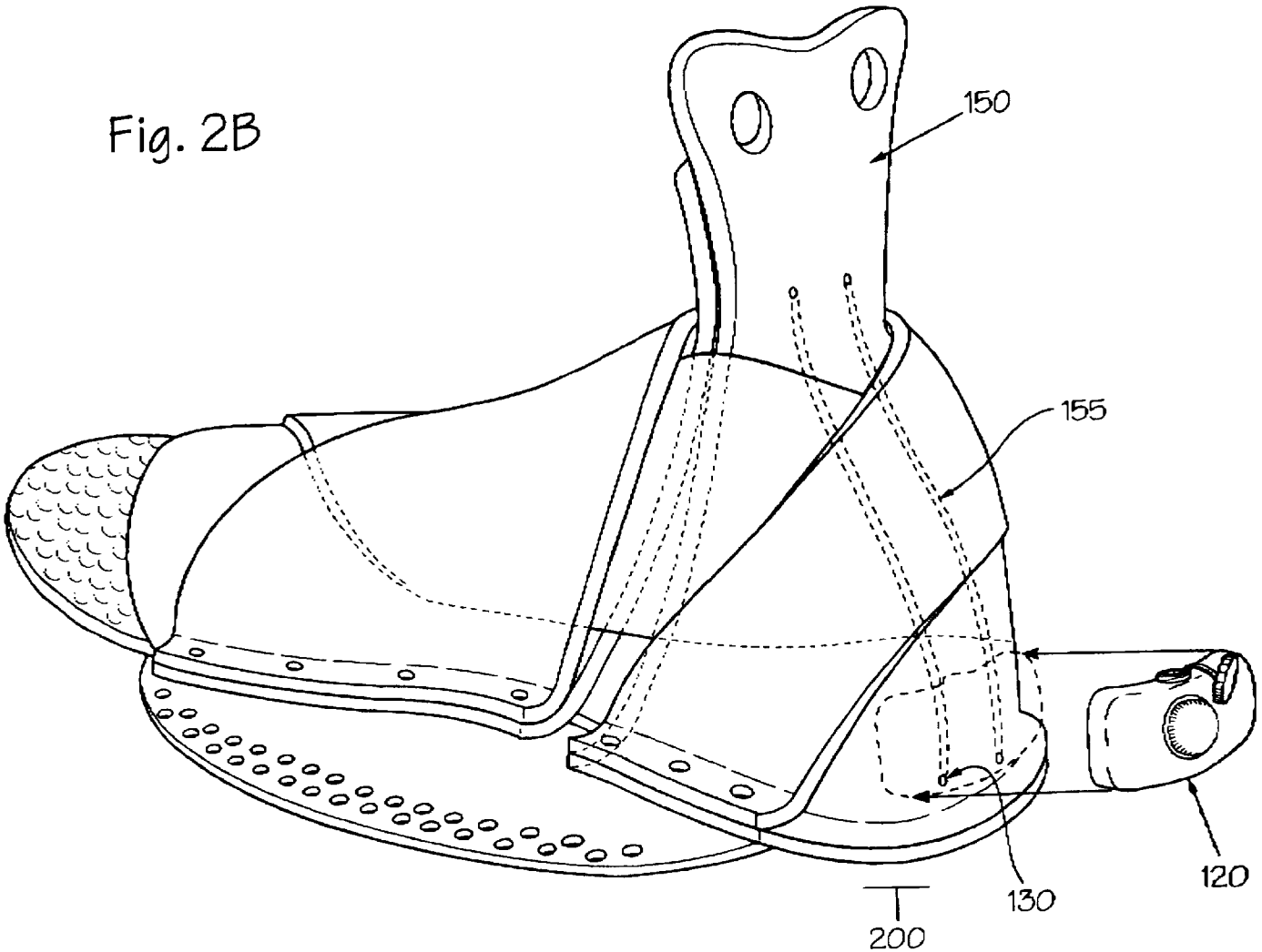
Figure 3B:
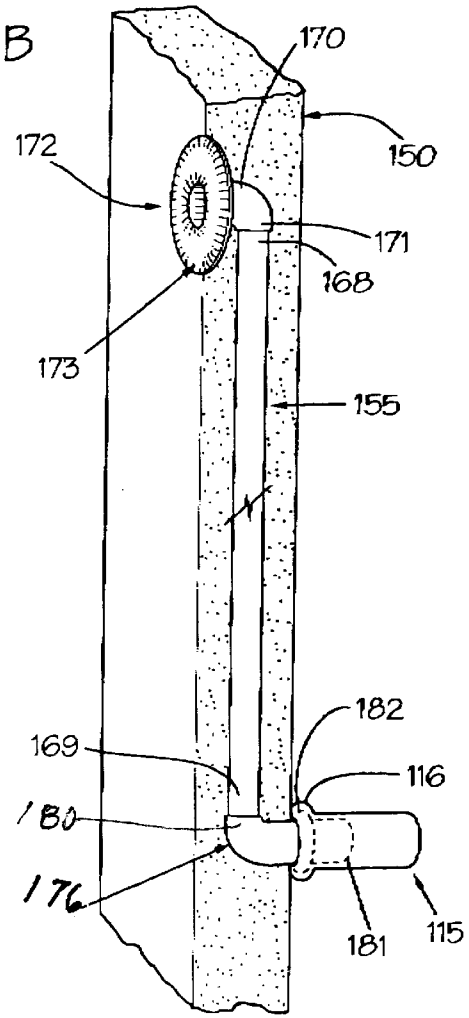
FIG. 3 shows a top view (FIG. 3A) of a disassembled embodiment illustrating one version of how the reservoir can be snapped into place; and a side view of an embodiment having ducts embedded into the material of the binding.
Figure 3A:
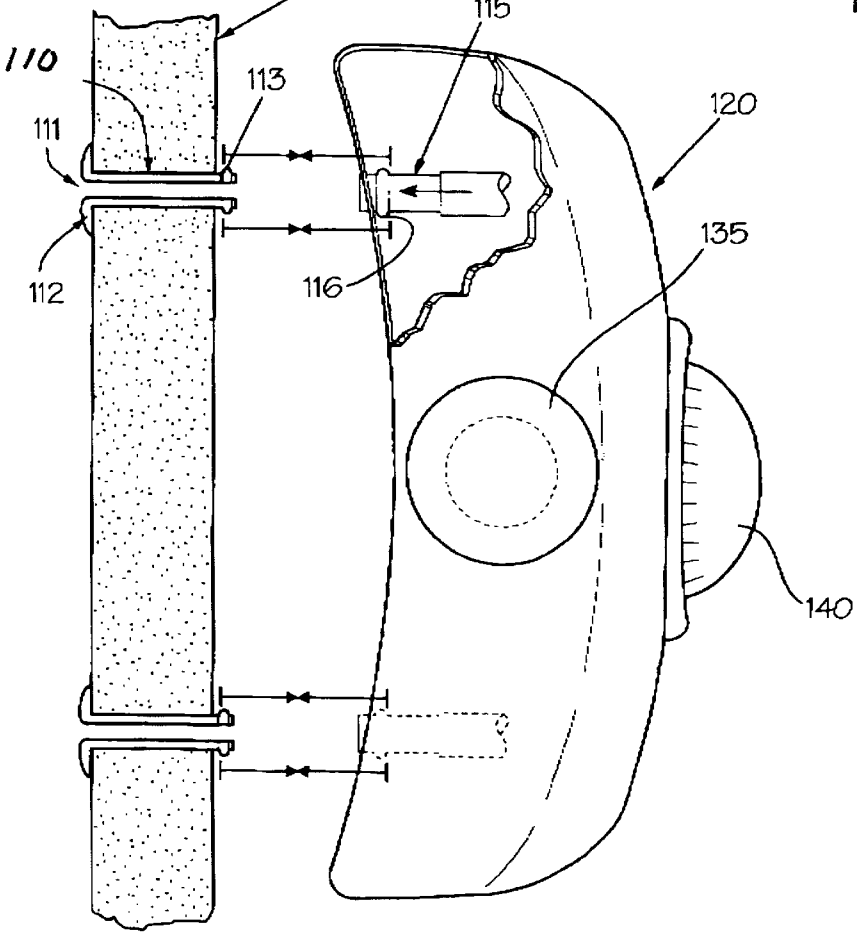

FIG. 2A shows a disassembled side perspective view of embodiment 100 of the subject binding which shows holes 130 defined at the top of the heel portion 150 of the binding for accommodating ducts 110 (See FIG. 3A). FIG. 2B shows another embodiment 200 of the subject binding comprising a reservoir body 120 attached to the bottom of the heel portion 150 of the binding 200. Ducts 155 (dashed lines) are embedded into heel portion 150 (see FIG. 2B) and traverse to the top of the heel portion 150 where lubricant is ultimately delivered.

The top view in FIG. 3A shows a preferred method of attaching the reservoir body to the heel portion 150. Duct 110 having a first end 111 configured with a flange 112 is positioned through the heel portion 150. Duct 110 comprises a second end having a raised ridge 113 which snaps into an accepting groove 116 defined in receiving channel 115 of the reservoir body 120. The flange 112 acts to secure the reservoir to the heel portion 150. The receiving channel 115 is in fluid communication with the pump button via the internal duct system of the reservoir body (not shown).

FIG. 3B shows a transverse cross section of the embodiment 200 shown in FIG. 2B to expose ducts 155 which are embedded in the material of the heel portion 150. The duct 155 has a first end 168 which is connected to a first elbow 170 at its interior end 171. The exterior end 172 of the elbow 170 comprises a flange 173. The second end 169 of duct 155 connects to a second elbow 176 at its interior end 180. The exterior end 181 of second elbow 176 comprises a raised ridge 182 which assists in snapping and securing elbow 176 at a accepting groove 116 of receiving channel 115 of the reservoir body.

It should be understood that the examples and embodiments described herein are for illustrative purposes only and that various modifications or changes in light thereof will be suggested to persons skilled in the art and are to be included within the spirit and purview of this application and the scope of the appended claims.

The teachings of all references cited herein are incorporated in their entirety to the extent they are not inconsistent with the teachings herein.

What is claimed is:

1. A binding for a water recreational device comprising a reservoir body for storing a lubricant, said reservoir body being disposed on a portion of said binding, and wherein said reservoir body has at least one opening out of which said lubricant is transferred, wherein said binding further comprises a manual pump in fluid communication with said reservoir body, and wherein upon actuating said pump, lubricant is transferred out of said reservoir body.

2. The binding of claim 1, further comprising at least one duct in fluid communication with said opening, wherein said at least one duct directs lubricant to a site of need.

3. The binding of claim 1, wherein said reservoir body is made of a flexible material, and wherein upon depressing said reservoir body, said lubricant is transferred out of said reservoir body.

4. The binding of claim 1, wherein said manual pump is actuated by depressing a button, switch, lever or bulb disposed on said reservoir body.

5. The binding of claim 1, further comprising a first duct having a first end connected to said reservoir body and a second end connected to said manual pump, and a second duct having a first end connected to said manual pump and a second open end; wherein upon acuating said pump, lubricant is ejected out of said second open end.

6. A method of facilitating the entry of a foot into a binding of a water recreational device comprising providing onto said binding a reservoir body for storing a lubricant, wherein said reservoir body comprises at least one hole out of which lubricant is transferred; and delivering said lubricant to a site of need on said binding, wherein said binding comprises a manual pump in fluid communication with said reservoir body, and wherein said delivering comprises actuating said pump such that lubricant is transferred out of said reservoir body to the site of need.

7. The method of claim 6, wherein said reservoir body is made of flexible material and wherein delivering said lubricant comprises depressing said reservoir body.

8. The method of claim 6 wherein said actuating comprises depressing a button, switch, lever, or bulb disposed on said reservoir body.

9. The method of claim 6, wherein a first duct is connected to said reservoir body and to said manual pump, and wherein a second duct having a first end and a second open end is connected to said manual pump; whereby upon actuating said pump, lubricant is ejected out of said second open end.

* * * * *